US008811850B2

(12) United States Patent
Ohata et al.

(10) Patent No.: US 8,811,850 B2
(45) Date of Patent: Aug. 19, 2014

(54) FIXING DEVICE AND IMAGE FORMING APPARATUS INCLUDING THE SAME

(71) Applicant: KYOCERA Document Solutions Inc., Osaka (JP)

(72) Inventors: Shinobu Ohata, Osaka (JP); Shoko Gon, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/066,603

(22) Filed: Oct. 29, 2013

(65) Prior Publication Data

US 2014/0119786 A1 May 1, 2014

(30) Foreign Application Priority Data

Oct. 30, 2012 (JP) ..... 2012-239461

(51) Int. Cl.
*G03G 21/20* (2006.01)
*G03G 15/20* (2006.01)
*H05B 6/10* (2006.01)

(52) U.S. Cl.
CPC ..... *G03G 15/2053* (2013.01); *G03G 21/206* (2013.01); *G03G 15/2017* (2013.01); *H05B 6/102* (2013.01)
USPC ..... 399/92; 399/328

(58) Field of Classification Search
USPC ..... 399/328, 92, 324, 329, 330, 122
See application file for complete search history.

(56) References Cited

U.S. PATENT DOCUMENTS

2006/0205578 A1 9/2006 Ogawa et al.

FOREIGN PATENT DOCUMENTS

| | | | | |
|---|---|---|---|---|
| JP | 2000321903 A | | 11/2000 | |
| JP | 2001313162 | * | 11/2001 | ..... H05B 6/14 |
| JP | 2002072764 A | | 3/2002 | |
| JP | 2005321622 A | | 11/2005 | |
| JP | 2006285216 A | | 10/2006 | |
| JP | 2007304315 A | * | 11/2007 | |
| JP | 2011197185 A | * | 10/2011 | |
| JP | 2012088355 A | | 5/2012 | |

* cited by examiner

*Primary Examiner* — Billy Lactaoen
(74) *Attorney, Agent, or Firm* — Alleman Hall McCoy Russell & Tuttle LLP

(57) ABSTRACT

A fixing device includes an auxiliary duct. The auxiliary duct is provided between a cover member attached to a coil bobbin so as to cover a magnetic core and a coil, and a core holder provided opposing to the coil bobbin, to which the magnetic core is attached. The auxiliary duct communicates with an intake hole provided at one end in a longitudinal direction of the cover member, and has opening holes overlapping with some of holder opening portions formed on the core holder. The fixing device causes air to flow into between the core holder and the coil bobbin via the auxiliary duct and the holder opening portions from the intake hole, and discharges the air warmed by heat of the coil from an exhaust hole formed at the other end of the cover member, thereby adjusting the flowing amount of air in a longitudinal direction of the coil.

7 Claims, 8 Drawing Sheets

FIXING DEVICE AND IMAGE FORMING APPARATUS INCLUDING THE SAME

INCORPORATION BY REFERENCE

This application is based upon and claims the benefit of priority from the corresponding Japanese Patent Application No. 2012-239461 filed on Oct. 30, 2012, the entire contents of which are incorporated herein by reference.

BACKGROUND

The present disclosure relates to a fixing device used for a copy machine, a printer, a facsimile, a multifunction peripheral including these, or the like, and an image forming apparatus including the fixing device. Particularly, the present disclosure relates to a fixing device of electromagnetic induction heating type and an image forming apparatus including the same.

In image forming apparatuses of electrophotographic type, a halogen heater or the like is widely used as a heat source for a fixing device which fixes a toner image on a recording medium. Meanwhile, in recent years, there is a demand for reduction of warm-up time or energy saving. In addition, an induction heating (IH) type is known in which an alternating magnetic field is interlinked with a magnetic conductor to cause eddy current, thereby providing heating.

In the induction heating type, an induction heating coil is used. The induction heating coil is formed by winding a litz wire along the outer circumferential surface of a bobbin extending in the width direction (direction perpendicular to a sheet conveyance direction) of a heating member such as a heating roller or a fixing belt. When high-frequency current is applied to the induction heating coil, high-frequency magnetic flux occurs. The high-frequency magnetic flux acts on an induction heat generation layer of the heating roller or the fixing belt, whereby eddy current occurs around the magnetic flux of the induction heat generation layer. Thus, Joule heat due to resistance intrinsic to a material in the induction heat generation layer occurs, thereby heating the heating member such as the heating roller or the fixing belt. The fixing device of IH type enables reduction of the heat capacitance of the heating member. Therefore, warm-up time is reduced and an enhanced heat conversion efficiency is obtained with a compact configuration.

In the above IH type, there are various placement manners for the coil relative to the heating member. One of them is to place the coil outside the heating member. In one such example, the heating member is a heating roller, and an induction heating coil is wound in the rotation axis direction (longitudinal direction). In another such example, the heating member is a heating belt, and an induction heating coil is wound in the belt width direction. Hereinafter, such a configuration is referred to as an outer surrounding type (axis direction winding) coil.

Meanwhile, in order to prevent the temperature of the coil from increasing to exceed the heat resistant temperature, the fixing device of IH type may include a cooling mechanism which blows air to the coil by using a fan. For example, a fixing device of IH type is proposed which includes a cooling mechanism that causes air to pass in the longitudinal direction of the coil.

In addition, a fixing device of IH type is proposed which includes a cooling mechanism that causes air to pass in the sheet passing direction (direction perpendicular to the longitudinal direction of the coil) of a paper sheet and uses air flow having been used for cooling the coil, for separating a paper sheet at a fixing nip portion.

SUMMARY

A fixing device according one aspect of the present disclosure includes a heating member, a pressurizing member, and an induction heating portion. The heating member includes an induction heat generation layer. The pressurizing member is pressed to the heating member at a predetermined pressure. The induction heating portion heats the induction heat generation layer of the heating member by induction heating by magnetic flux. The induction heating portion includes a coil, a magnetic core, a coil bobbin, a core holder, a cover member, and an auxiliary duct. The coil is wound in a loop manner along a longitudinal direction of the heating member and generates the magnetic flux for heating the heating member by induction heating. The magnetic core is arranged, in the vicinity of the coil, in a direction perpendicular to a conveyance direction of a recording medium, and conducts the magnetic flux into the induction heat generation layer of the heating member. The coil bobbin is provided opposing to a surface of the heating member, and the coil is attached on an attachment surface of the coil bobbin opposite to a surface thereof opposing to the heating member. The core holder is provided opposing to the coil bobbin, and the magnetic core is attached on the core holder. The cover member is attached to the coil bobbin so as to cover the magnetic core and the coil. The auxiliary duct is provided between the cover member and the core holder. The auxiliary duct communicates with an intake hole provided at one end in a longitudinal direction of the cover member, and has opening holes overlapping with some of a plurality of holder opening portions formed on the core holder. The fixing device causes air to flow into between the core holder and the coil bobbin via the auxiliary duct and the holder opening portion from the intake hole, and discharges the air warmed by heat of the coil from an exhaust hole formed at the other end of the cover member, thereby adjusting the flowing amount of air flowing in a longitudinal direction of the coil.

An image forming apparatus according another aspect of the present disclosure includes a fixing device. The fixing device includes a heating member, a pressurizing member, and an induction heating portion. The heating member includes an induction heat generation layer. The pressurizing member is pressed to the heating member at a predetermined pressure. The induction heating portion heats the induction heat generation layer of the heating member by induction heating by magnetic flux. The induction heating portion includes a coil, a magnetic core, a coil bobbin, a core holder, a cover member, and an auxiliary duct. The coil is wound in a loop manner along a longitudinal direction of the heating member and generates the magnetic flux for heating the heating member by induction heating. The magnetic core is arranged, in the vicinity of the coil, in a direction perpendicular to a conveyance direction of a recording medium, and conducts the magnetic flux into the induction heat generation layer of the heating member. The coil bobbin is provided opposing to a surface of the heating member, and the coil is attached on an attachment surface of the coil bobbin opposite to a surface thereof opposing to the heating member. The core holder is provided opposing to the coil bobbin, and the magnetic core is attached on the core holder. The cover member is attached to the coil bobbin so as to cover the magnetic core and the coil. The auxiliary duct is provided between the cover member and the core holder. The auxiliary duct communicates with an intake hole provided at one end in a longitudinal direction of the cover member, and has opening holes overlapping with some of a plurality of holder opening portions formed on the core holder. The fixing device causes air to flow into between the core holder and the coil bobbin via the auxiliary duct and the holder opening portion from the intake hole, and discharges the air warmed by heat of the coil from an exhaust hole formed at the other end of the cover member, thereby adjusting the flowing amount of air flowing in a longitudinal direction of the coil.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
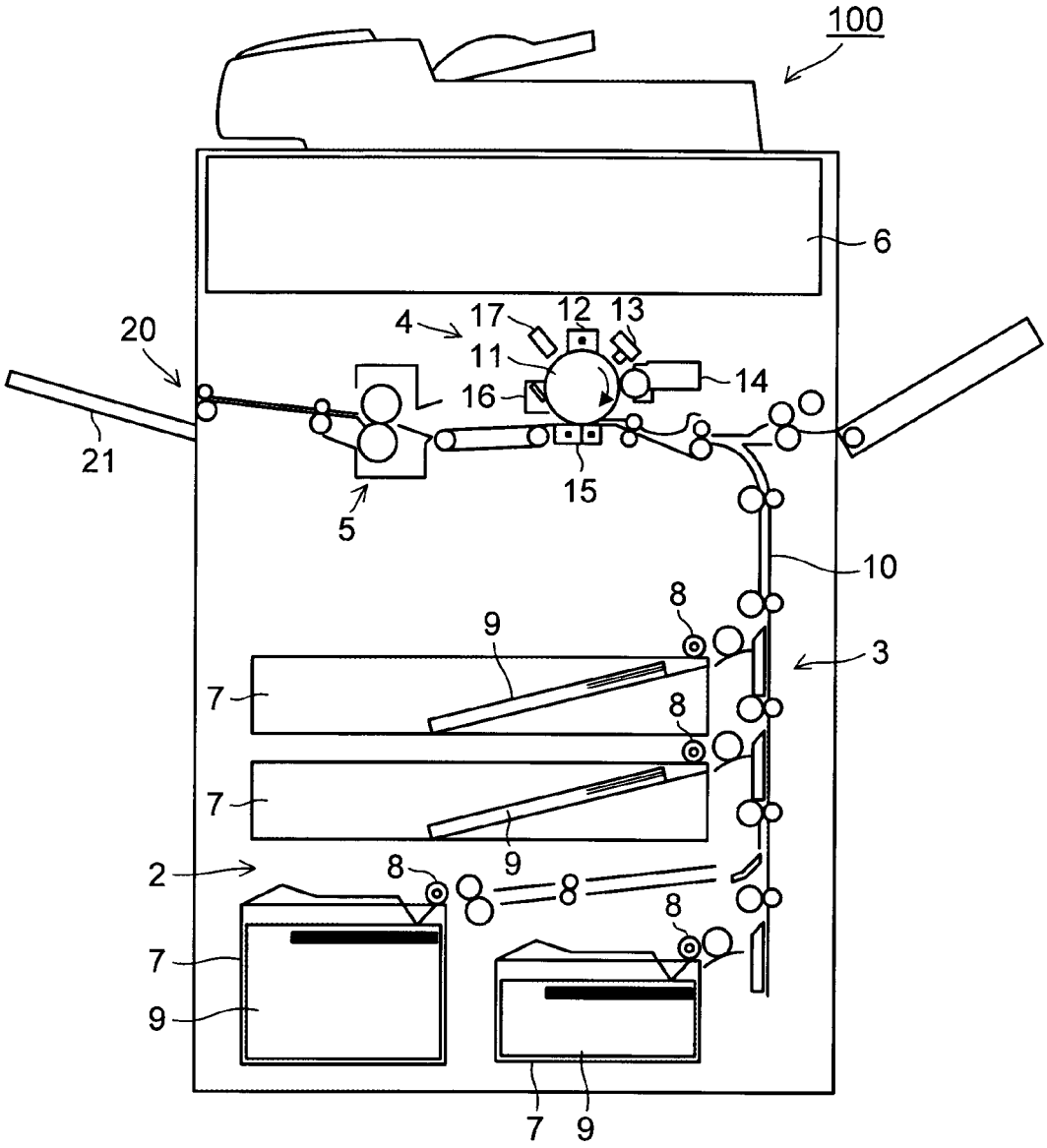
FIG. 1 is a schematic configuration diagram of an image forming apparatus including a fixing device according to one embodiment of the present disclosure.

Hereinafter, embodiments of the present disclosure will be described with reference to the drawings. FIG. 1 is a diagram showing the schematic configuration of an image forming apparatus 100 including a fixing device 5 according to the present disclosure. The image forming apparatus 100 includes a sheet feed portion 2 provided at a lower portion thereof, and a sheet conveyance portion 3 provided laterally to the sheet feed portion 2. In addition, the image forming apparatus 100 includes an image forming portion 4 provided above the sheet conveyance portion 3, a fixing device 5 provided on the discharge side relative to the image forming portion 4, and an image reading portion 6 provided above the image forming portion 4 and the fixing device 5.

The sheet feed portion 2 includes a plurality of sheet feed cassettes 7 for containing a paper sheet 9 as a recording medium. The sheet feed portion 2 feeds a paper sheet 9 one by one from a sheet feed cassette 7 selected from the plurality of sheet feed cassettes 7 by rotation of a sheet feed roller 8, to the sheet conveyance portion 3.

The paper sheet 9 fed to the sheet conveyance portion 3 is conveyed through a sheet conveyance path 10 provided in the sheet conveyance portion 3, to the image forming portion 4. The image forming portion 4 forms a toner image on the paper sheet 9 through an electrophotographic process. The image forming portion 4 includes a photosensitive drum 11 supported so as to be rotatable in an arrow direction in FIG. 1. In addition, the image forming portion 4 includes a charging portion 12, an exposure portion 13, a developing portion 14, a transfer portion 15, a cleaning portion 16, and an electricity removing portion 17, which are provided around the photosensitive drum 11 along the rotation direction thereof.

The charging portion 12 includes a charging wire to which high voltage is to be applied. The charging portion 12 provides predetermined potential onto the surface of the photosensitive drum 11 by corona discharge from the charging wire, thereby uniformly charging the surface of the photosensitive drum 11. Then, when light based on image data of a document read by the image reading portion 6 is radiated to the photosensitive drum 11 by the exposure portion 13, the surface potential of the photosensitive drum 11 is selectively attenuated, whereby an electrostatic latent image is formed on the surface of the photosensitive drum 11.

Subsequently, the developing portion 14 develops the electrostatic latent image on the surface of the photosensitive drum 11 by using a toner, thereby forming a toner image on the surface of the photosensitive drum 11. The transfer portion 15 transfers the toner image onto a paper sheet 9 fed to between the photosensitive drum 11 and the transfer portion 15.

The paper sheet 9 having the toner image transferred thereon is conveyed to the fixing device 5 provided on the downstream side in the sheet conveyance direction in the image forming portion 4. In the fixing device 5, the paper sheet 9 is heated and pressurized, whereby the toner image is melted and fixed on the paper sheet 9. Subsequently, the paper sheet 9 having the toner image 9 fixed thereon is discharged onto a discharge tray 21 by a discharge roller pair 20.

After the toner image is transferred onto the paper sheet 9 by the transfer portion 15, a residual toner on the surface of the photosensitive drum 11 is removed by the cleaning portion 16. In addition, a residual electric charge on the surface of the photosensitive drum 11 is removed by the electricity removing portion 17. Then, the photosensitive drum 11 is charged again by the charging portion 12, and thereafter, image formation is to be performed in the same manner.

Figure 2:
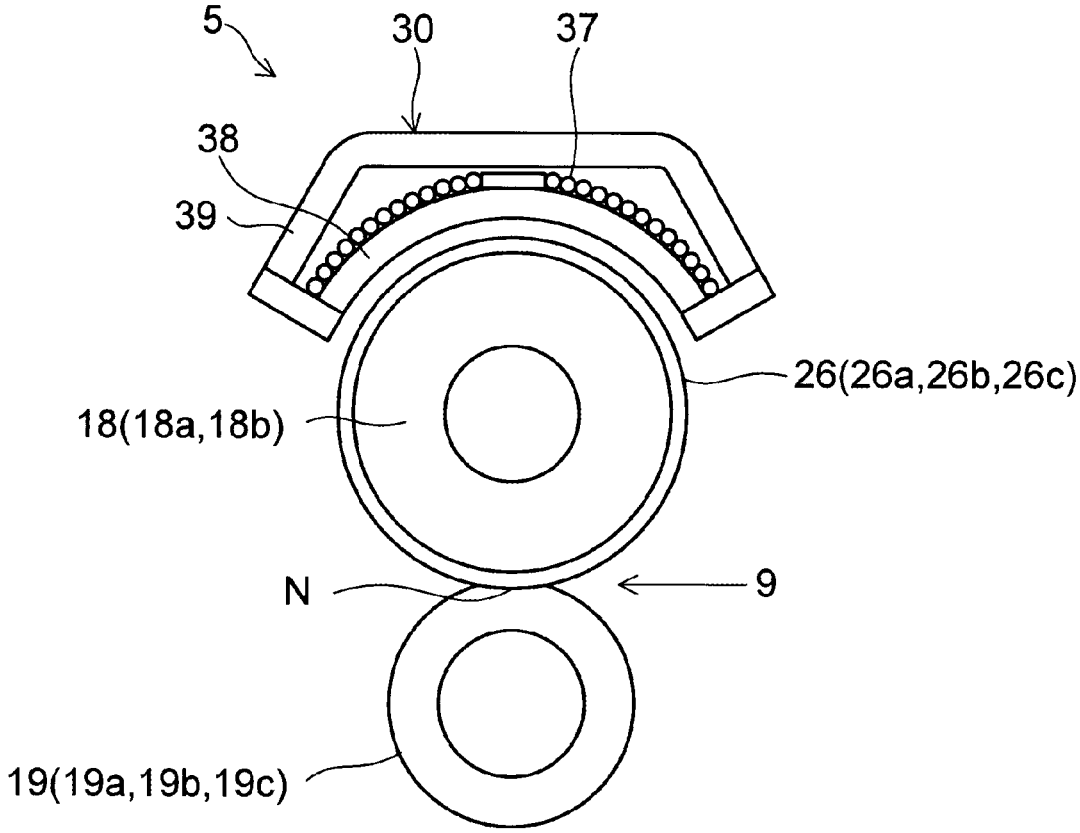
FIG. 2 is a side sectional view of the fixing device shown in FIG. 1.

FIG. 2 is a side sectional view showing schematically the fixing device 5 according to one embodiment of the present disclosure. For the fixing device 5, an IH type using a heat source of induction heating type is employed. The fixing device 5 includes a heating belt 26 as a heating member and a pressurizing roller 19 as a pressurizing member. In addition, the fixing device 5 includes a fixing roller 18 provided inside the heating belt 26, and an induction heating portion 30 which supplies magnetic flux to the heating belt 26. The pressurizing roller 19 and the fixing roller 18 are supported in a rotatable manner in the longitudinal direction of a housing (not shown)

of the fixing device 5. The induction heating portion 30 is fixed and supported by the housing (not shown) of the fixing device 5.

The heating belt 26 is a heat resistant belt of endless type. The heating belt 26 is formed by laminating, sequentially from the inner circumferential side, an induction heat generation layer 26*a* formed by, for example, electroformed nickel with a thickness of 30 to 50 μm, an elastic layer 26*b* formed by, for example, a silicone rubber with a thickness of 200 to 500 μm, and then a release layer 26*c* formed by a fluororesin such as a PFA (tetrafluoroethylene-perfluoroalkylvinylether copolymer) for enhancing a release property upon melting and fixing of an unfixed toner image at a nip portion N.

The fixing roller 18 stretches the inner circumferential surface of the heating belt 26 so that the fixing roller 18 can rotate integrally with the heating belt 26. For example, the fixing roller 18 has an outer diameter set at 39.8 mm, and includes a core metal 18*a* made of stainless steel and an elastic layer 18*b* formed by a silicone rubber with a thickness of 5 to 10 mm, the elastic layer 18*b* being provided on the core metal 18*a* and stretching the heating belt 26.

The pressurizing roller 19 includes a cylindrical core metal 19*a*, an elastic layer 19*b* formed on the core metal 19*a*, and a release layer 19*c* covering the surface of the elastic layer 19*b*. For example, the pressurizing roller 19 has an outer diameter set at 35 mm, and includes the elastic layer 19*b* formed by a silicone rubber with a thickness of 2 to 5 mm and provided on the core metal 19*a* made of stainless steel, and the release layer 19*c* formed by fluororesin such as a PFA and provided on the elastic layer 19*b*. The pressurizing roller 19 is rotationally driven by a drive source such as a motor (not shown), whereby the heating belt 26 rotates so as to follow the rotation of the pressurizing roller 19. The nip portion N is formed at a portion where the pressurizing roller 19 and the heating belt 26 are pressed to each other. At the nip portion N, an unfixed toner image on a conveyed paper sheet 9 is heated and pressurized, whereby the toner image is fixed on the paper sheet 9.

The induction heating portion 30 includes a coil 37, a coil bobbin 38, and a magnetic core 39, and causes the heating belt 26 to generate heat by electromagnetic induction. The induction heating portion 30 extends in the longitudinal direction (direction perpendicular to the drawing plane of FIG. 2), and is provided opposing to the heating belt 26 so as to surround substantially the half of the outer circumference of the heating belt 26.

The coil 37 is attached on the coil bobbin 38 such that the coil 37 is wound thereon with several turns in a loop manner along the width direction (direction perpendicular to the drawing plane of FIG. 2) of the heating belt 26. In addition, the coil 37 is connected to a power supply (not shown) and generates AC magnetic flux based on high-frequency current supplied from the power supply. Further, the surface temperatures of a center portion and an end portion in the longitudinal direction (axis direction) of the heating belt 26 are detected by a thermistor (not shown), and the high-frequency current supplied from the power supply to the coil 37 is controlled based on the detection result. The magnetic flux from the coil 37 passes through the magnetic core 39, to be conducted in a direction parallel to the drawing plane of FIG. 2, and then passes along the induction heat generation layer 26*a* of the heating belt 26. Variation as AC in the strength of the magnetic flux passing through the induction heat generation layer 26*a* causes eddy current in the induction heat generation layer 26*a*. When eddy current flows in the induction heat generation layer 26*a*, Joule heat occurs due to electric resistance of the induction heat generation layer 26*a*, whereby the heating belt 26 generates heat (self heat generation).

When the heating belt 26 is heated to a predetermined temperature, a paper sheet 9 held at the nip portion N is heated, and is pressurized by the pressurizing roller 19, whereby a toner in a powder state on the paper sheet 9 is melted and fixed on the paper sheet 9. Thus, since the heating belt 26 is formed by a thin material having an excellent thermal conductivity and has a small thermal capacitance, short-time warm-up is enabled, whereby image formation is swiftly started.

Figure 3:
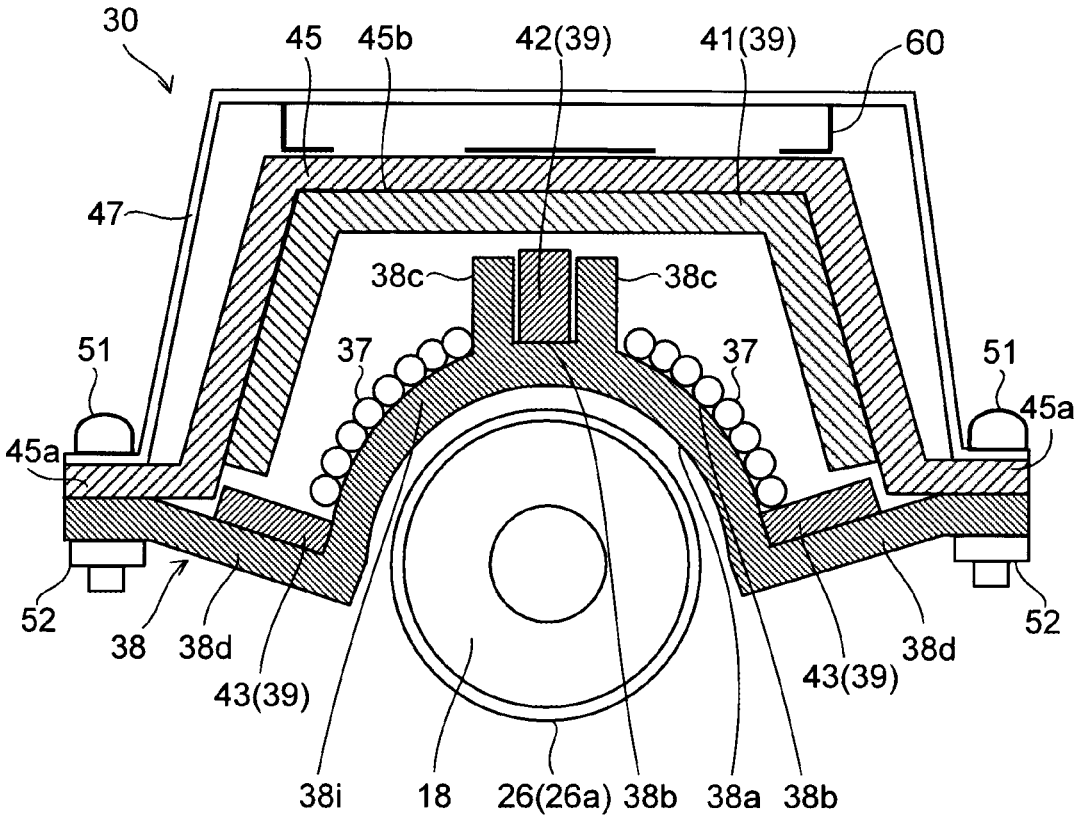
FIG. 3 is a side sectional view showing the configuration of an induction heating portion used for the fixing device shown in FIG. 1.

FIG. 3 is a side sectional view of the induction heating portion 30 used for the fixing device 5 of the present embodiment. As described above, the induction heating portion 30 includes the coil 37, the coil bobbin 38 as a support member, and the magnetic core 39. The magnetic core 39 includes an arch core 41 as a first core, a center core 42 as a second core, and a side core 43. Further, the induction heating portion 30 includes an arch core holder 45 which allows the arch core 41 to be attached thereto, and a cover member 47 covering the magnetic core 39 and the coil 37.

The coil bobbin 38 is provided being spaced by a predetermined distance from the surface of the heating belt 26 and being centered on the rotation center axis of the fixing roller 18. The coil bobbin 38 includes an arc portion 38*i* surrounding substantially the half of the circumferential surface of the heating belt 26, and flange portions 38*d* extending from both ends of the arc portion 38*i*. The arc portion 38*i* and the flange portion 38*d* constitute a main framework of the coil bobbin 38, and have a thickness of, for example, 1 to 2 mm, or desirably, 1.5 mm, so as to maintain the strength of the framework. In addition, the arc portion 38*i* and the flange portion 38*d* are formed by a heat resistant resin such as an LCP resin (liquid crystal polymer), a PET resin (polyethylene terephthalate resin), or a PPS resin (polyphenylene sulfide resin), so as to be resistant to heat emitted from the heating belt 26.

The arc portion 38*i* of the coil bobbin 38 has an opposing surface 38*a* opposing to the surface of the heating belt 26 via a predetermined distance, and an arc-shaped attachment surface 38*b* positioned on a side opposite to the opposing surface 38*a*. A pair of center cores 42 are attached by an adhesive agent substantially at the center of the attachment surface 38*b*, that is, on a line connecting the rotation center axes of the fixing roller 18 and the pressurizing roller 19 (see FIG. 2). A rising wall portion 38*c* rising from the attachment surface 38*b* is formed around the center cores 42 so as to extend in the longitudinal direction (direction perpendicular to the drawing plane of FIG. 3). In addition, the coil 37 is attached on the attachment surface 38*b*. The distance between the surface of the heating belt 26 and the opposing surface 38*a* of the coil bobbin 38 is set at, for example, 1.5 to 3 mm so that the heating belt 26 does not contact when rotating, and the center core 42 is provided being spaced by 4 mm from the surface of the heating belt 26.

The coil 37 is formed by twisting a plurality of enamel wires in a combined manner and coating them with a fusing layer. For example, an AIW wire having a heat resistant temperature of about 200° C. is used for the coil 37. The coil 37 wound in a loop manner around the longitudinal direction (direction perpendicular to the drawing plane of FIG. 3) along the attachment surface 38*b* so as to have an arc shape in its sectional view is heated to melt the fusing layer, and then cooled to be fixed in a predetermined shape (loop shape). The coil 37 fixed in the predetermined shape is placed around the rising wall portion 38*c* of the coil bobbin 38 and attached on the attachment surface 38*b* by a silicone adhesive agent or the like.

A plurality of side cores 43 are attached on the arc portion 38*i* side of each flange portion 38*d* by an adhesive agent so as to be arranged in the longitudinal direction. In addition, the arch core holder 45 is attached on the outer edge sides of the flange portions 38*d*.

The arch core holder 45 includes holder flange portions 45*a* attached on the flange portion 38*d* of the coil bobbin 38, and a plurality of core attachment portions 45*b* extending in an arch shape from the holder flange portions 45*a* and arranged in the longitudinal direction. The arch core 41 having substantially the same arch shape as the core attachment portion 45*b* is attached to each core attachment portion 45*b* by an adhesive agent.

Accordingly, when the arch core 41, and the center core 42 and the side core 43 are respectively attached at predetermined positions on the coil bobbin 38 and the arch core holder 45 as described above, the arch core 41 and the side core 43 surround the outside of the coil 37. In addition, the center core 42 is provided closer to the surface of the heating belt 26 than the arch core 41 is. Further, the coil 37 is surrounded by the surface of the heating belt 26, the side core 43, the arch core 41, and the center core 42. When high-frequency current is supplied to the coil 37, magnetic flux generated from the coil 37 is conducted into the side core 43, the arch core 41, and the center core 42, thereby flowing along the heating belt 26. At this time, eddy current occurs in the induction heat generation layer 26*a* of the heating belt 26, and Joule heat is generated therein due to electric resistance of the induction heat generation layer 26*a*, whereby the heating belt 26 generates heat.

The cover member 47 shields a magnetic field generated from the induction heating portion 30. The cover member 47 is formed by a plate material made of, for example, aluminum so as to cover the coil 37 and the magnetic core 39 in a surrounding manner from a side opposite to the coil bobbin 38. Attachment of the cover member 47 is performed by putting the holder flange portion 45*a* of the arch core holder 45 and then a flange portion of the cover member 47 on the flange portion 38*d* of the coil bobbin 38 and then fastening a screw 51 into a nut 52.

An auxiliary duct 60 is provided between the arch core holder 45 and the cover member 47. The auxiliary duct 60 adjusts a flow path of air flowing in from an intake hole 47*a* (see FIG. 6) of the cover member 47 and flowing between the arch core holder 45 and the cover member 47. The configuration and the function of the auxiliary duct 60 will be described later.

Figure 4:
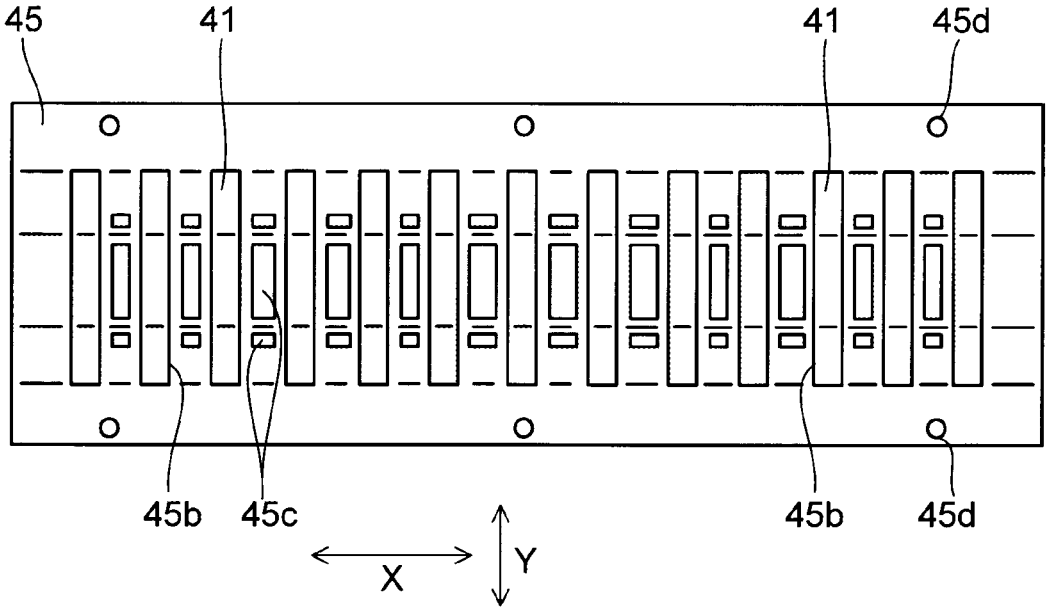
FIG. 4 is a plane view showing arrangement of an arch core relative to an arch core holder as seen from the lower side (coil bobbin side) in FIG. 3.
Figure 5:
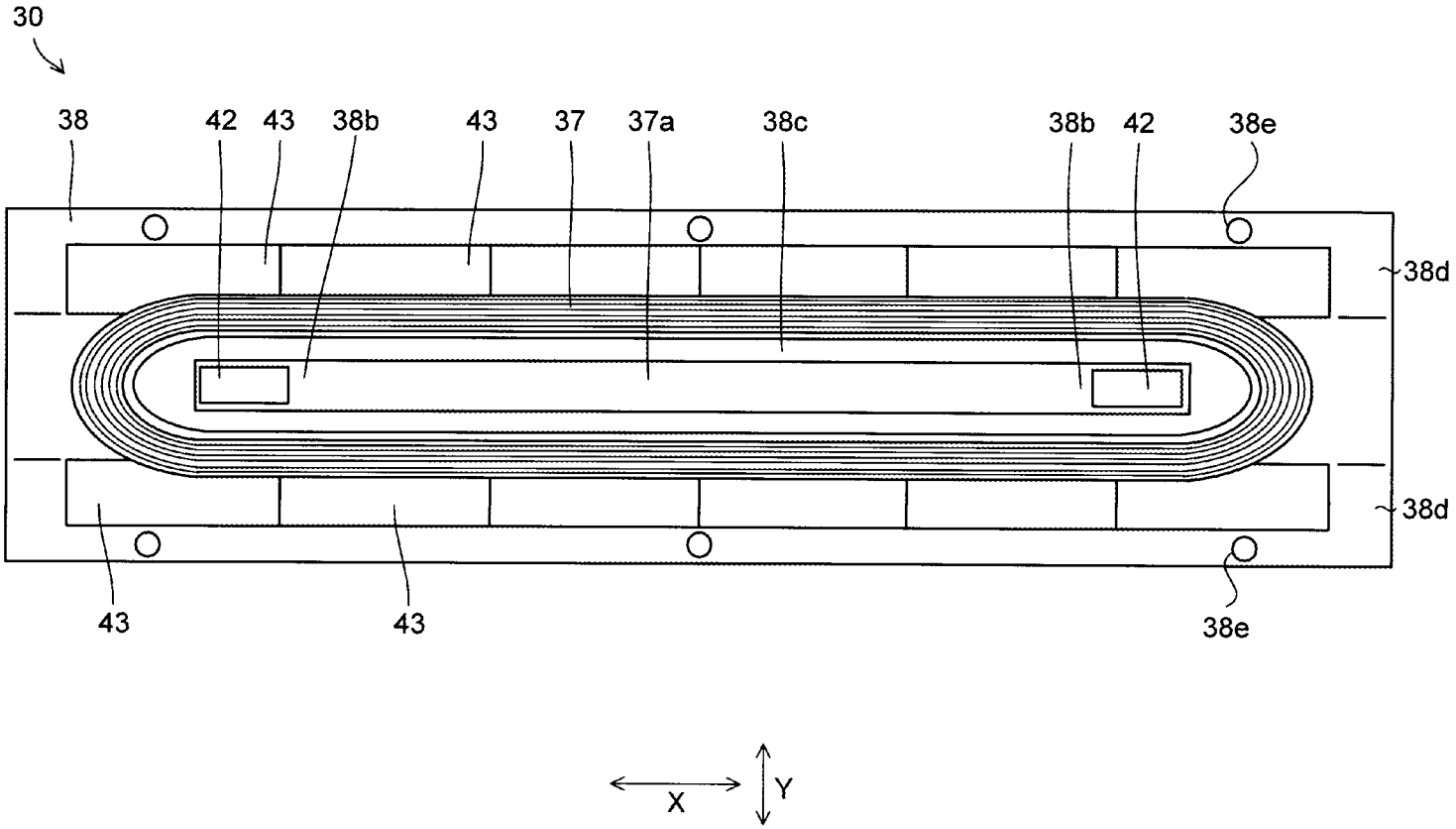
FIG. 5 is a plane view showing arrangement of a coil, and a center core and a side core, relative to the coil bobbin, as seen from the upper side (arch core holder side) in FIG. 3.

FIG. 4 is a plane view showing arrangement of the arch core 41 relative to the arch core holder 45 as seen from the lower side (coil bobbin 38 side) in FIG. 3. FIG. 5 is a plane view showing arrangement of the coil 37, the center core 42, and the side core 43 relative to the coil bobbin 38 as seen from the upper side (arch core holder 45 side) in FIG. 3.

As shown in FIG. 4, the arch core holder 45 is provided with the core attachment portion 45*b* which allows the arch core 41 to be attached thereon at a predetermined position. A plurality of the core attachment portions 45*b* are formed substantially at regular intervals in a longitudinal direction X (direction perpendicular to a sheet conveyance direction Y). A holder opening portion 45*c* is formed between adjacent core attachment portions 45*b*. In addition, a plurality of screw holes 45*d* for inserting the screws 51 (see FIG. 3) which allow the arch core holder 45 to be attached on the coil bobbin 38 (see FIG. 3) are formed around the core attachment portions 45*b*. The arch core 41 is made from a ferrite having a high permeability such as Mn—Zn-based alloy and is formed in an arch shape having a rectangular shape in a sectional view.

As shown in FIG. 5, the coil bobbin 38 includes the rising wall portion 38*c* rising on a center portion of the attachment surface 38*b* and extending along the longitudinal direction X, and the flange portions 38*d* extending along the longitudinal direction X on both sides of the attachment surface 38*b*. The flange portion 38*d* is provided with a plurality of screw holes 38*e* for inserting the screw 51 (see FIG. 3). A plurality of side cores 43 are attached on the flange portion 38*d*. The side core 43 is made from a ferrite having a high permeability such as Mn—Zn-based alloy and is formed in a cuboid shape.

The rising wall portion 38*c* of the coil bobbin 38 includes linear wall portions extending in the longitudinal direction X and opposing to each other, and arc-shaped wall portions extending between said opposing wall portions and forming outer edges on both ends in the longitudinal direction X.

The outer circumference of the rising wall portion 38*c* is formed substantially in the same shape as a hollow portion 37*a* formed inside the loop of the wound coil 37, so that the coil 37 can be attached by fitting the hollow portion 37*a* of the coil 37 onto the outer circumference of the rising wall portion 38*c*. For example, the inner dimension of the hollow portion 37*a* of the coil 37 is set at 330 mm in the longitudinal direction X and 10 mm in the Y direction (sheet conveyance direction) perpendicular to the longitudinal direction X. On the other hand, the outer dimension of the rising wall portion 38*c* is set at 329 mm in the longitudinal direction X and 9.4 mm in the Y direction.

A rectangular space that allows a pair of center cores 42 to be placed therein is formed inside the inner circumference of the rising wall portion 38*c*. The rectangular space has a length corresponding to a sheet passing area for a paper sheet 9 with the maximum size in the longitudinal direction X that allows toner to be fixed. The thickness of the rising wall portion 38*c* is set so as to suppress radiation and transmission of heat of the excited coil 37 to the center core 42. For example, the thickness (length from outer circumference to the inner circumference) of the rising wall portion 38*c* is set at 1.5 mm and the length in the Y direction of the rectangular space is set at 6.4 mm.

A pair of center cores 42 are attached in the rectangular space of the rising wall portion 38*c*. The pair of center cores 42 are provided at positions corresponding to non sheet passing areas formed on, when the smaller size paper sheet 9 passes through the nip portion N, both ends of a sheet passing area for a smaller size paper sheet 9 than the maximum size paper sheet 9. The center core 42 is made from a ferrite having a high permeability such as Mn—Zn-based alloy and is formed in a cuboid shape.

Figure 6:
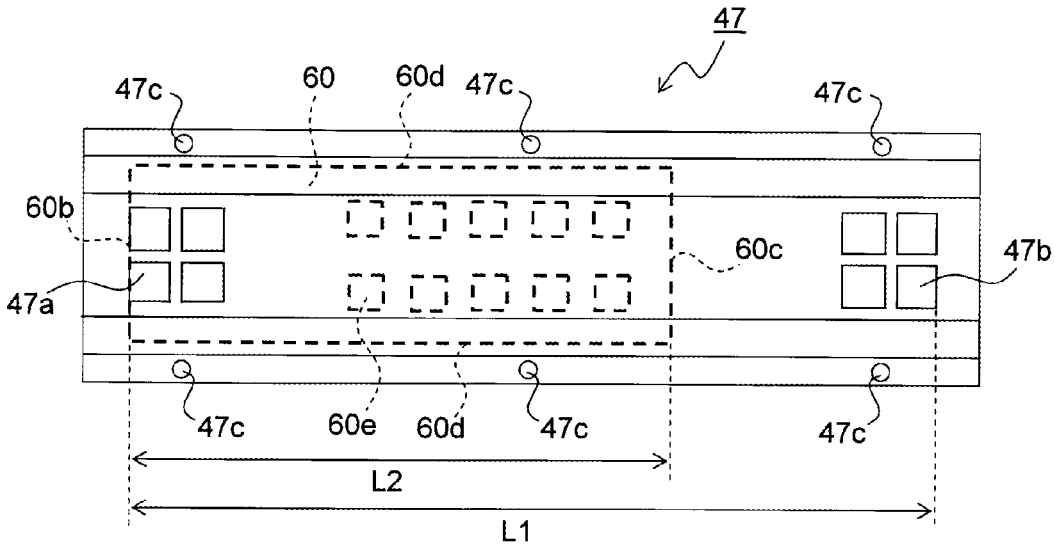
FIG. 6 is a plane view of a cover member included in the fixing device shown in FIG. 1, as seen from the upper side in FIG. 3.
Figure 7:
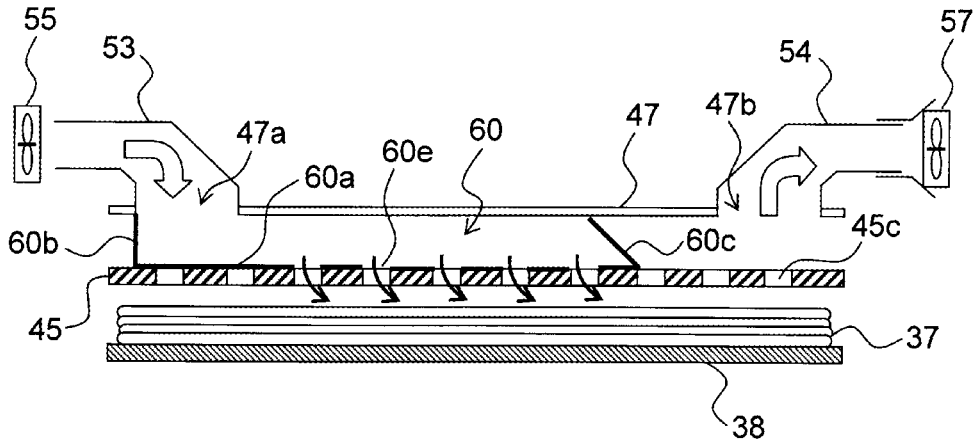
FIG. 7 is a side sectional view of the induction heating portion included in the fixing device shown in FIG. 1, when cut along a longitudinal direction.

FIG. 6 is a plane view of the cover member 47 as seen from the upper side in FIG. 3. FIG. 7 is a side sectional view of the induction heating portion 30 when cut along the longitudinal direction X. In FIG. 7, the arch core 41, the center core 42, and the side core 43 covered by the cover member 47 are not shown. With reference to FIGS. 6 and 7, a coil cooling mechanism for the induction heating portion 30 will be described.

When current is applied to the coil 37 to generate magnetic flux in the induction heating portion 30, the coil 37 generates heat by itself, whereby the temperature in the cover member 47 increases. Accordingly, as a coil cooling mechanism that can suppress temperature increase of the coil 37, an intake duct 53, an exhaust duct 54, an intake fan 55, an exhaust fan 57, and the auxiliary duct 60 are provided.

The cover member 47 has an intake hole 47*a* and an exhaust hole 47*b* formed on an upper surface thereof. The intake hole 47*a* and the exhaust hole 47*b* are provided on respective ends in the longitudinal direction X of the cover member 47. The intake duct 53 is connected to the intake hole 47*a*, and the exhaust duct 54 is connected to the exhaust hole 47*b*. The intake fan 55 is provided facing to the upstream side of the intake duct 53 in the flowing direction (from left to right in FIG. 7) of air, and the exhaust fan 57 is provided facing to the downstream side of the exhaust duct 56. In addition, a plurality of screw holes 47*c* for inserting the screws 51 (see FIG. 3) are formed along the side edges of the cover member 47 in the longitudinal direction.

The auxiliary duct 60 made from synthetic resin is provided in a space between the cover member 47 and the arch core holder 45. The auxiliary duct 60 includes a bottom surface 60*a* contacting the upper surface of the arch core holder 45, an upstream-side rising wall portion 60*b* and a downstream-side rising wall portion 60*c* respectively rising at an upstream-side end and a downstream-side end in the air flowing direction of the bottom surface 60*a*, and a pair of lateral rising wall portions 60*d* rising on side edges parallel to the air flowing direction. A plurality of opening holes 60*e* are formed on the bottom surface 60*a*. The opening holes 60*e* are formed at positions overlapping with the holder opening portions 45*c* of the arch core holder 45.

When the intake fan 55 is rotationally driven, external air flows into the auxiliary duct 60 via the intake hole 47*a* from the intake duct 53. The air flowing in the auxiliary duct 60 passes through the opening holes 60*e* and the holder opening portions 45*c* to flow into a space between the arch core holder 45 and the coil bobbin 38. Then, the air flowing therein takes heat generated from the coil 37, thereby cooling the coil 37.

The air warmed by the heat generated from the coil 37 flows upward through the holder opening portion 45*c* by rotation of the exhaust fan 57, and then flows into the space above the arch core holder 45 again. Thereafter, the air is discharged to the outside via the exhaust hole 47*b* from the exhaust duct 54.

Here, at a portion opposing to the intake hole 47*a* of the cover member 47, if air flowing in from the intake duct 53 directly reaches the coil 37 via the holder opening portion 45*c* of the arch core holder 45, the temperature at the upstream-side end (left end in FIG. 7) of the coil 37 in the flowing direction of the air may decrease more than intended. On the other hand, in a range from the center to the downstream-side end (right end in FIG. 7) in the longitudinal direction of the coil 37, a sufficient amount of air does not flow, so that the coil temperature in this range may increase to be higher than the heat resistant temperature.

Here, if an air passage duct that passes air in a direction perpendicular to the longitudinal direction of the coil 37 is provided, a cooling effect for the coil 37 is obtained almost uniformly across the entire range in the longitudinal direction. Therefore, a temperature difference in the longitudinal direction of the coil 37 becomes less likely to occur. However, it is difficult to design such an air passage duct, and a problem arises that the size of the duct becomes large and its configuration is complicated.

Accordingly, in the present embodiment, the auxiliary duct 60 is provided in the space above the arch core holder 45 in order to adjust the air flow amount for the coil 37 in the longitudinal direction of the induction heating portion 30.

Specifically, at a portion opposing to the intake hole 47*a* of the cover member 47, the opening hole 60*e* is not formed on the bottom surface 60*a* of the auxiliary duct 60. On the bottom surface 60*a* of the auxiliary duct 60, the opening holes 60*e* are formed at portions opposing to a range from slightly upstream to slightly downstream with respect to the center in the longitudinal direction of the coil 37. Thus, the flowing amount of air reaching the upstream-side end of the coil 37 in the flowing direction of the air is suppressed, and the flowing amount of air reaching a range from slightly upstream to downstream with respect to the center in the longitudinal direction of the coil 37 increases. Therefore, the coil 37 can be efficiently cooled substantially in a uniformed manner across the entire range in the longitudinal direction.

The length of the auxiliary duct 60 in the flowing direction of air is set so as to at least extend downstream with respect to the center in the longitudinal direction of the coil 37. This is because heat is likely to be accumulated in a range from the center to downstream in the longitudinal direction of the coil 37, and therefore the flowing amount of air reaching such a range is increased, thereby performing efficient cooling. However, if the auxiliary duct 60 is extended to the downstream-side end of the coil 37, the flowing amount of air reaching the downstream-side end of the coil 37 increases too much, so that the cooling effect in a range from the center to upstream in the longitudinal direction of the coil 37 decreases.

Therefore, as shown in FIG. 6, in the case where L1 denotes the length from the upstream-side opening edge of the intake hole 47*a* of the cover member 47 to the downstream-side opening edge of the exhaust hole 47*b*, and L2 denotes the length of the auxiliary duct 60 in the flowing direction of air, the length of the auxiliary duct 60 may be set in a range of $(1/2)L1<L2<(3/4)L1$.

In addition, as shown in FIG. 7, the inner surface of the downstream-side rising wall portion 60*c* of the auxiliary duct 60 may be inclined to descend in the flowing direction of air (in a direction approaching the arch core holder 45 from upstream to downstream in the flowing direction of air). By this configuration, air reaching the downstream-side end of the auxiliary duct 60 flows along the inclined inner surface of the downstream-side rising wall portion 60*c* toward the arch core holder 45, whereby the air can smoothly reach the coil 37 via the holder opening portion 45*c*.

Figure 8:
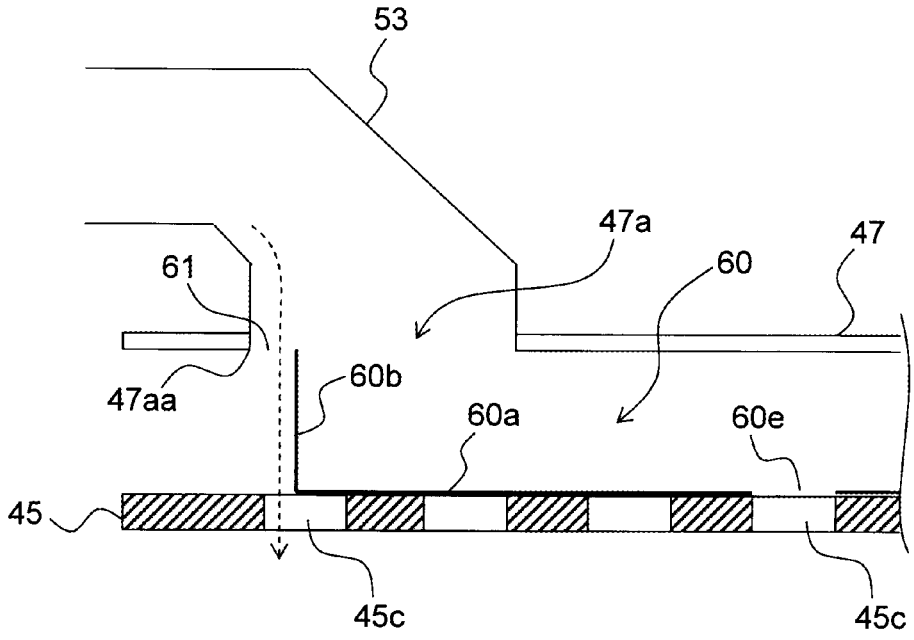
FIG. 8 is a partial sectional view of the induction heating portion included in the fixing device shown in FIG. 1, showing a configuration in which a gap is provided between an intake hole of the cover member and an upstream-side rising wall portion of an auxiliary duct.

In addition, it may be also desired to enhance the cooling effect for the upstream side of the coil 37 in order to adjust the temperature balance in the longitudinal direction of the coil 37. In this case, as shown in FIG. 8, if a gap 61 is provided between the intake hole 47*a* of the cover member 47 and the upstream-side rising wall portion 60*b* of the auxiliary duct 60, a slight amount of air can be introduced into between the arch core holder 45 and the coil bobbin 38 via the gap 61 and the holder opening portion 45*c* from the intake duct 53. An appropriate dimension of the gap 61 is several mm to about 5 mm.

Figure 9:
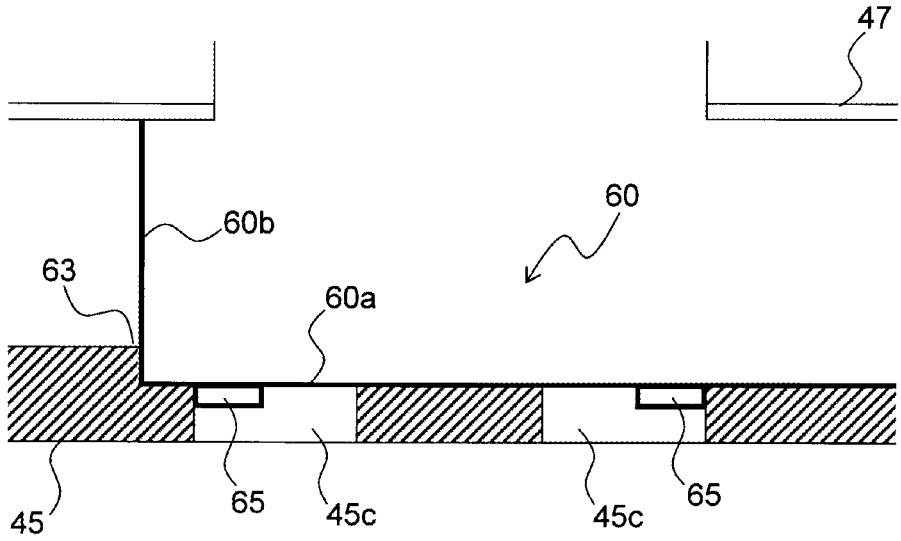
FIG. 9 is a partial sectional view showing a positioning mechanism for the auxiliary duct included in the fixing device shown in FIG. 1.

Next, positioning and fixation method for the auxiliary duct 60 will be described. FIG. 9 is a partial sectional view showing a positioning mechanism for the auxiliary duct 60. With regard to the longitudinal direction (right-left direction in FIG. 9) of the coil 37 and the circumferential direction (direction perpendicular to the drawing plane of FIG. 9) of the coil 37 in its sectional view, the auxiliary duct 60 is positioned by a corner of the auxiliary duct 60 contacting a step portion 63 of the arch core holder 45 or by a rib 65 protruding downward from the bottom surface 60*a* of the auxiliary duct 60 and engaged with the holder opening portion 45*c*. The longitudinal direction of the coil 37 and the circumferential direction of the coil 37 in its sectional view are directions parallel to the opposing surface between the cover member 47 and the arch core holder 45 (that is, a surface of the arch core holder 45 opposing to the cover member 47).

It is noted that the step portion 63 may be provided on the coil bobbin 38 instead of the arch core holder 45. In addition, a rib to be engaged with the opening hole 60*e* of the auxiliary duct 60 may be formed on the arch core holder 45. Further, as the positioning mechanism for the auxiliary duct 60, an engagement hole to be engaged with the rib 65 may be separately provided from the holder opening portion 45*c*, or a rib may be provided on the arch core holder 45 or the coil bobbin 38 and a corresponding engagement hole may be provided on the auxiliary duct 60.

In addition, with regard to a direction perpendicular to the opposing surface between the cover member 47 and the arch core holder 45, specifically, the height direction of the coil 37 (up-down direction in FIG. 9), the auxiliary duct 60 is positioned by the arch core holder 45 and the cover member 47 sandwiching the bottom surface 60*a* and the upper ends of the upstream-side rising wall portion 60*b*, the downstream-side rising wall portion 60*c*, and the lateral rising wall portion 60*d*. In this state, as shown in FIG. 3, the screw 51 is inserted into the screw hole 47*c* (see FIG. 6) of the cover member 47 and the screw hole 45*d* (see FIG. 4) of the arch core holder 45, and then the screw 51 is fastened with the nut 52, whereby the cover member 47 and the auxiliary duct 60 are fixed with each other.

As described above, the auxiliary duct 60 is placed at a predetermined position on the arch core holder 45, and the cover member 47 together with the auxiliary duct 60 is fastened by the screw 51, whereby they are fixed. Therefore, it is not necessary to directly fasten the auxiliary duct 60 itself by a screw or the like. Therefore, the induction heating portion 30 can be easily assembled without increase in the number of assembly steps therefor. That is, the coil cooling mechanism included in the fixing device 5 has a simple configuration.

Figure 10:
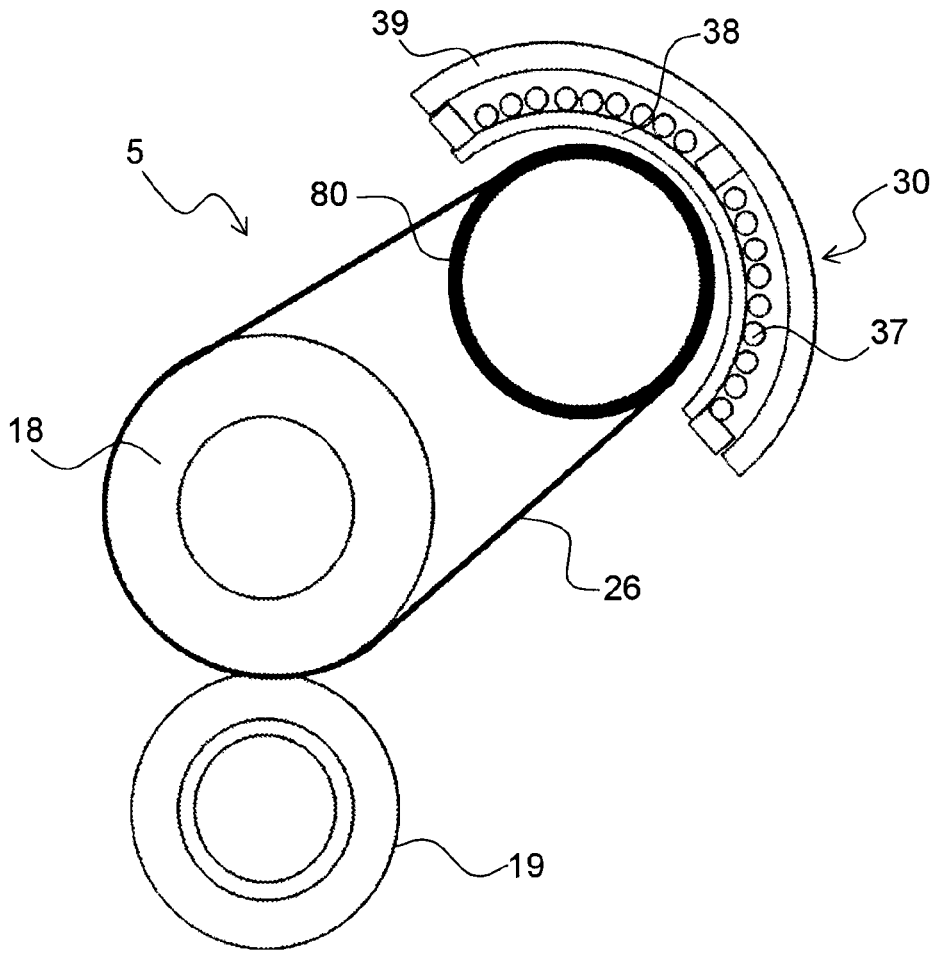
FIG. 10 is a side sectional view showing a fixing device according to another embodiment of the present disclosure.

The present disclosure is not limited to the above embodiments, and may be modified in various manners without deviating from the gist of the present disclosure. For example, in the above embodiment, application to the fixing device 5 in which the heating belt 26 is stretched on the fixing roller 18 has been shown, but the present disclosure is not limited thereto. As shown in FIG. 10, the present disclosure may be applied to the fixing device 5 in which the heating belt 26 of endless type is stretched between a heat roller 80 provided opposing to the induction heating portion 30 and the fixing roller 18 to which the pressurizing roller 19 is pressed.

Alternatively, the present disclosure may be applied to a fixing device including an induction heating portion that heats a heating belt of endless type, a pressurizing roller to be pressed to the outer circumferential surface of the heating belt, and a pressing member that is provided on the inner circumferential surface of the heating belt and causes a paper sheet and the heating belt to be pressed to each other between the pressing member and the pressurizing roller. Still alternatively, the present disclosure may be applied to a fixing device including a pressurizing roller and a heating roller to be pressed to the pressurizing roller, in which the heating roller incorporates an induction heat generation layer and is provided opposing to an induction heating portion. Thus, the present disclosure can be applied to various fixing devices including an induction heating portion.

In the above embodiments, the arch core 41 and the side core 43 are provided separately from each other, but the present disclosure is not limited thereto. The arch core 41 may be further extended toward the side core 43, whereby the arch core 41 may also function as the side core 43.

The present disclosure is applicable to a fixing device of IH type, used for a copy machine, a printer, a facsimile, a multifunction peripheral including these, or the like, and an image forming apparatus including the fixing device. Application of the present disclosure can provide a fixing device of IH type that can effectively prevent deterioration due to overheat of a coil with a compact and simple duct configuration.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a heating member including an induction heat generation layer;

a pressurizing member to be pressed to the heating member at a predetermined pressure; and an induction heating portion including:

a coil that is wound in a loop manner along a longitudinal direction of the heating member and generates magnetic flux for heating the heating member by induction heating;

a magnetic core that is arranged, in the vicinity of the coil, in a direction perpendicular to a conveyance direction of a recording medium, and conducts the magnetic flux into the induction heat generation layer of the heating member;

a coil bobbin provided opposing to a surface of the heating member, the coil being attached on an attachment surface of the coil bobbin opposite to a surface thereof opposing to the heating member;

a core holder provided opposing to the coil bobbin, the magnetic core being attached on the core holder;

a cover member attached to the coil bobbin so as to cover the magnetic core and the coil; and an auxiliary duct provided between the cover member and the core holder, the auxiliary duct communicating with an intake hole provided at one end in a longitudinal direction of the cover member, and the auxiliary duct having opening holes overlapping with some of a plurality of holder opening portions formed on the core holder, the induction heating portion being configured to heat the induction heat generation layer of the heating member by induction heating by the magnetic flux, wherein air is caused to flow into between the core holder and the coil bobbin via the auxiliary duct and the holder opening portions from the intake hole, and the air warmed by heat of the coil is discharged from an exhaust hole formed at the other end of the cover member, thereby adjusting the flowing amount of air flowing in a longitudinal direction of the coil.

2. The fixing device according to claim 1, wherein $(1/2)L1<L2<(3/4)L1$ is satisfied, where L1 is a length from an upstream-side edge of the intake hole to a downstream-side edge of the discharge hole in a flowing direction of the air and L2 is a length of the auxiliary duct in the flowing direction of the air.

3. The fixing device according to claim 1, wherein the auxiliary duct is configured such that an inner surface of a downstream-side rising wall portion rising at a downstream-side end in the flowing direction of the air is inclined so as to approach the core holder from upstream to downstream in the flowing direction of the air.

4. The fixing device according to claim 1, wherein the auxiliary duct is configured such that the opening holes are formed at positions not overlapping with the intake hole in the longitudinal direction of the cover member.

5. The fixing device according to claim 1, wherein the auxiliary duct is placed with a gap provided between an upstream-side rising wall portion rising at an upstream-side end in the flowing direction of the air, and an upstream-side edge of the intake hole.

6. The fixing device according to claim 1, wherein the auxiliary duct is positioned in a direction parallel to a surface of the core holder opposing to the cover member by being engaged with the core holder or the coil bobbin, and is positioned in a direction perpendicular to the surface of the core holder opposing to the cover member by the cover member and the core holder being fixed with each other.

7. An image forming apparatus comprising a fixing device, the fixing device including:

a heating member including an induction heat generation layer;

a pressurizing member to be pressed to the heating member at a predetermined pressure; and an induction heating portion including:

a coil that is wound in a loop manner along a longitudinal direction of the heating member and generates magnetic flux for heating the heating member by induction heating;

a magnetic core that is arranged, in the vicinity of the coil, in a direction perpendicular to a conveyance direction of a recording medium, and conducts the magnetic flux into the induction heat generation layer of the heating member;

a coil bobbin provided opposing to a surface of the heating member, the coil being attached on an attachment surface of the coil bobbin opposite to a surface thereof opposing to the heating member;

a core holder provided opposing to the coil bobbin, the magnetic core being attached on the core holder;

a cover member attached to the coil bobbin so as to cover the magnetic core and the coil; and an auxiliary duct provided between the cover member and the core holder, the auxiliary duct communicating with an intake hole provided at one end in a longitudinal direction of the cover member, and the auxiliary duct having opening holes overlapping with some of a plurality of holder opening portions formed on the core holder, the induction heating portion being configured to heat the induction heat generation layer of the heating member by induction heating by the magnetic flux, wherein air is caused to flow into between the core holder and the coil bobbin via the auxiliary duct and the holder opening portions from the intake hole, and the air warmed by heat of the coil is discharged from an exhaust hole formed at the other end of the cover member, thereby adjusting the flowing amount of air flowing in a longitudinal direction of the coil.

* * * * *